US005313990A

United States Patent [19]

Clüsserath

[11] Patent Number: 5,313,990

[45] Date of Patent: May 24, 1994

[54] METHOD AND APPARATUS FOR FILLING CONTAINERS WITH LIQUID MATERIAL

[75] Inventor: Ludwig Clüsserath, Bad Kreuznach, Fed. Rep. of Germany

[73] Assignee: Seitz Enzinger Noll Maschinenbau Aktiengesellschaft, Mannheim, Fed. Rep. of Germany

[21] Appl. No.: 962,308

[22] Filed: Oct. 16, 1992

[30] Foreign Application Priority Data

Oct. 17, 1991 [DE] Fed. Rep. of Germany ..... 4134366
Apr. 25, 1992 [DE] Fed. Rep. of Germany ..... 4213737

[51] Int. Cl.[5] ..... B67C 3/06

[52] U.S. Cl. ..... 141/6; 141/39; 141/48; 141/90; 141/91; 141/147

[58] Field of Search ..... 141/6, 39, 40, 48, 63, 141/82, 92, 90, 91, 147

[56] References Cited

U.S. PATENT DOCUMENTS 2,330,726 9/1943 McKinnis ..... 141/92
4,679,603 7/1987 Rademacher ..... 141/39
4,693,054 9/1987 Spargo ..... 141/6 X
5,016,684 5/1991 Clusserath ..... 141/6
5,031,673 7/1991 Clusserath ..... 141/6
5,163,487 11/1992 Clusserath ..... 141/92

FOREIGN PATENT DOCUMENTS 0331137 3/1989 European Pat. Off. .
0019405 11/1990 European Pat. Off. ..... 141/92

*Primary Examiner*—Ernest G. Cusick
*Attorney, Agent, or Firm*—Robert W. Becker & Associates

[57] ABSTRACT

A method and apparatus for filling bottles or similar containers, whereby the containers are rinsed and pre-pressurized with an inert gas in a preliminary pressurizing phase that precedes the filling phase. For the rinsing as well as the at least partial pre-pressurization, the return gas from a return gas channel is utilized. To keep the return gas as free from bacteria as possible, the containers are treated with a sterilization medium in a preliminary treatment phase that precedes the preliminary pressurizing phase. Furthermore, air and sterilization medium that are displaced in the sterilization phase and in the preliminary pressurizing phase are withdrawn to the atmosphere or to a channel that is separate from the return gas channel.

42 Claims, 3 Drawing Sheets

METHOD AND APPARATUS FOR FILLING CONTAINERS WITH LIQUID MATERIAL

BACKGROUND OF THE INVENTION

The present invention relates to a method and apparatus for filling bottles or similar containers with liquid material using a filling element that has a liquid flow valve.

A method and associated apparatus of this general type for dispensing a liquid, especially carbonated, material under counterpressure into bottles or similar containers are known (EP-A-0 231 137). Also proposed in this known state of the art is the use of return gas from the return gas channel of the filling machine to reduce the consumption of inert gas or $CO_2$ gas in the preliminary pressurizing phase for a rinsing and partial pre-pressurizing of the respective container. However, with this known method and apparatus, when return gas is used the desired quality and ability to store the product, especially with a material that is sensitive or easily perishable, cannot be achieved with an adequate reliability, in particular due to the possible existence of bacteria in the return gas of the return gas channel.

In principle, it is also known from U.S. Pat. No. 5,031,673, Clusserath, to treat the respective container with a sterilization medium prior to the preliminary pressurizing stage, whereby however this treatment serves exclusively for dispensing the liquid material in an aseptic or sterile manner, and for this purpose the respective container is accommodated in a closable bell without being in a sealing position with the filling element; initially, the interior of the bell is acted upon by the sterilization medium and then during the filling process is, among others, acted upon by the pressure of an inert gas or with sterile air. Due to the volume of the bell, a disadvantageously high consumption of inert gas or sterile air results.

It is therefore an object of the present invention to improve a method and apparatus of the aforementioned general type in such a way that while maintaining the advantage of being able to reduce the consumption of inert gas, a high quality and long shelf life of the dispensed filling material can be achieved even where the material is sensitive.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
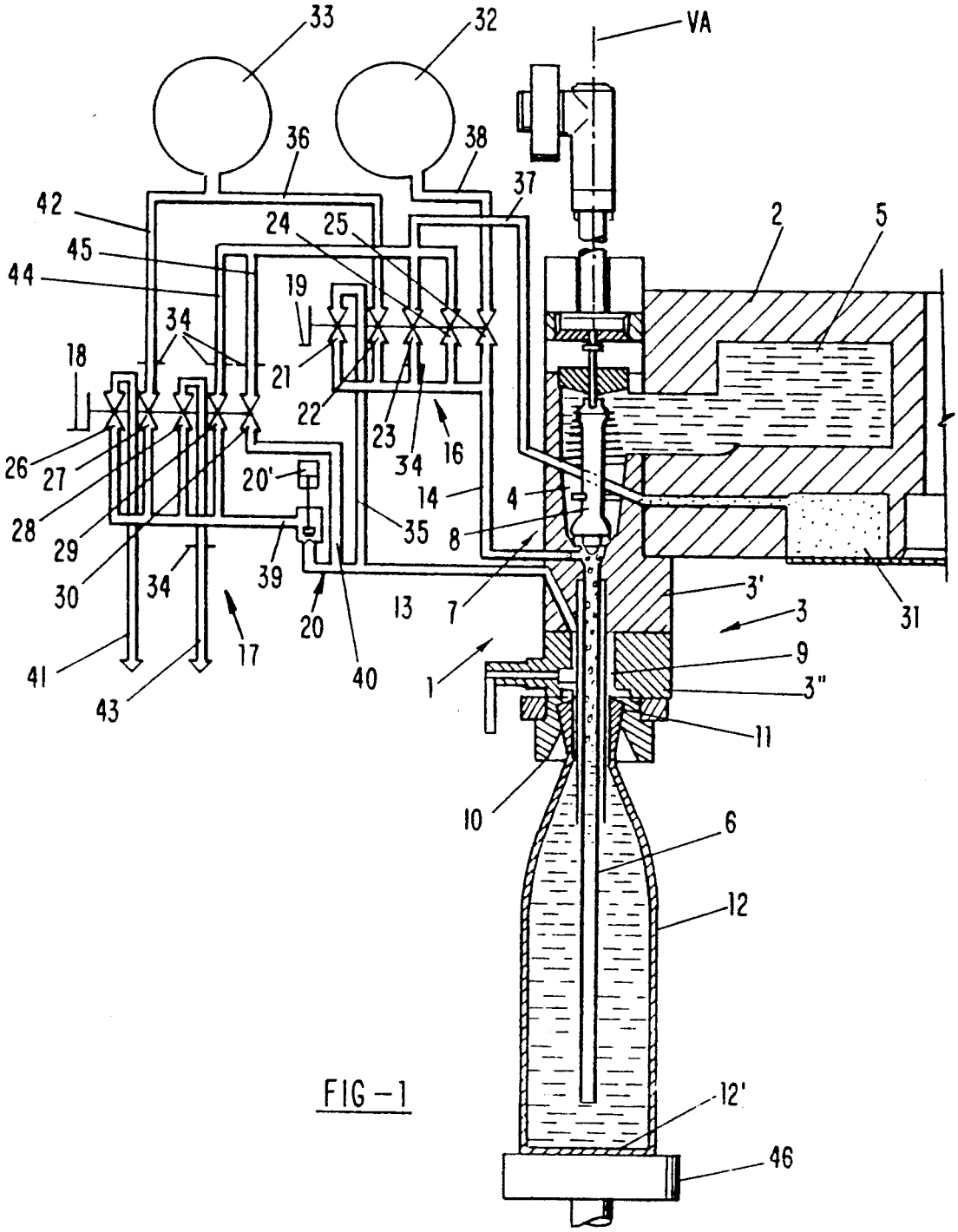
FIG. 1 is a partial cross-sectional view of a filling element of a rotating-type filling machine, with the filling element being provided on the periphery of a rotor that rotates about a vertical axis of rotation and having a long filling tube, with a bottle that is to be filled also being shown.

The method of the present invention includes the steps of: bringing the container into a filling position with the filling element; in a preliminary pressurizing phase, rinsing and at least partially pre-pressurizing the container with an inert gas; in a subsequent filling phase, with the liquid flow valve open, filling the container with the liquid material, whereby return gas that is displaced from the container by entering liquid material is at least for a time withdrawn via a return gas path of the filling element into a return gas channel, and whereby in the preliminary pressurizing phase the rinsing as well as the at least partial pre-pressurizing of the container is effected using, as the inert gas, the return gas from the return gas channel; in a preliminary treatment phase that precedes the preliminary pressurizing phase, treating the interior of the container with a sterilization medium, preferably steam, to displace air out of the interior of the container; and withdrawing the displaced air, as well as sterilization medium that is displaced out of the interior of the container by the rinsing step during the preliminary pressurizing phase, to the atmosphere and/or to a channel that is independent of the return gas channel.

Also with the inventive method, the rinsing as well as the partial pre-pressurizing of the respective container in the preliminary pressurizing phase are effected with the direct use of the return gas from the return gas channel. Despite the desired high quality and shelf life of the dispensed filling material, this is possible pursuant to the teachings of the present invention due to the fact that in the preliminary treatment phase at least the inner surfaces of the container are adequately sterilized and at the same time care is taken that only the return gas is conveyed into the return gas channel. In other words, neither is air that is displaced from the respective container by the sterilization medium during the preliminary treatment phase, nor is sterilization medium that is displaced during the rinsing of the container in the preliminary pressurizing phase, conveyed into the return gas channel. Rather, it is necessary to withdraw the displaced air and the displaced sterilization medium to the atmosphere or into a channel that is entirely separate or independent of the return gas channel.

With the present invention, the return gas in the return gas channel not only has a satisfactory micro-biological condition, i.e. the return gas is not contaminated, at all or at most to a harmless extent, with bacteria and other microorganisms, but rather in particular a nearly pure $CO_2$ atmosphere is achieved in the return gas channel.

Only due to the entirety of all of the measures of the inventive method is it possible, without compromising the quality and shelf life, to achieve a noticeable saving of expensive inert gas or $CO_2$ gas by using return gas.

The apparatus of the present invention comprises: at least one filling element which has a liquid flow valve; at least one control valve mechanism that is operatively associated with the filling element and has a plurality of valves with the control valve mechanism serving for the control of gas paths, formed in the filling element, at least during a preliminary pressurizing phase in which the containers, when in a sealing position with the filling element, are rinsed and at least partially pre-pressurized with an inert gas, and also during a subsequent filling phase in which the container, which is in the sealing position with the filling element, with the liquid flow valve open, is filled with the liquid material, whereby at least for a time return gas that is displaced from the container by entering liquid material is withdrawn via a return gas path of the filling element into a return gas channel, and whereby in the preliminary pressurizing phase the rinsing as well as the at least partial pre-pressurizing of the container is effected using, as the inert gas, the return gas from the return gas channel; a source for a sterilization medium, preferably steam, which, via the control valve mechanism, is adapted to act upon the interior of the container in a preliminary treatment phase that precedes the preliminary pressurizing phase, thereby displacing air out of the interior of the container; and outlet means for withdrawing the displaced air, as well as sterilization medium that is displaced out of the interior of the container during the rinsing in the preliminary pressurizing phase, to the atmosphere and/or a channel that is independent or separate from the return gas channel.

With the present invention it is possible to use filling elements of a straightforward construction. In particular, with the present invention it is not necessary for the filling elements to have bells that partially or entirely accommodate the containers.

Further specific features of the present invention will be described in detail subsequently.

DESCRIPTION OF PREFERRED EMBODIMENTS

Referring now to the drawings in detail, FIG. 1 shows a filling element 1 of a rotating-type filling machine. Along with further, similar filling elements, the filling element 1 is disposed on the periphery of a rotor member 2 that rotates about the vertical axis of the filling machine.

The filling element 1 essentially comprises a housing 3 that is composed of the two parts 3' and 3'', with the housing part 3'' forming the lower part of the filling element 1. A liquid channel 4 is formed in the housing part 3'. The upper portion of the liquid channel 4 communicates with an annular channel or reservoir 5 for the supply of the liquid material, while the lower portion of the liquid channel 4 communicates with the upper end of a long filling tube 6 that is coaxial with a vertical filling element axis VA and extends beyond the underside of the filling element 1.

Provided in the liquid channel 4 is the liquid flow valve 7 with the pertaining valve body 8.

Formed in the housing part 3'' is an annular channel 9 that concentrically surrounds the filling tube 6 as well as the axis VA. At the underside of the housing 3, the channel 9 is open, so that when, in a sealing position, the mouth 10 of the bottle 12 is pressed against the underside of the housing 3, i.e. against the seal 11 that is disposed there, the channel 9 communicates with the interior of the bottle.

The connecting line 13 opens out into the channel 9, while a connecting line 14 opens out into the liquid channel 4 downstream of the liquid flow valve 7.

Two control valve arrangements 16 and 17 are associated with the filling element 1. In the illustrated embodiment, each of these control valve arrangements 16, 17 is formed by a slide-valve mechanism with a control housing. Each of the control valve arrangements 16, 17 has an actuating lever 18 or 19 respectively that, as the filling machine rotates, cooperate with a stationary control element, for example with cams such as sequence cams disposed on a stationary control ring. In addition to the control valve arrangement 16 and 17, also associated with each filling element 1 is a control valve 20, which is, for example, a pneumatic or electrical valve, and has an actuating element 20' that is controlled by a non-illustrated control device.

The control valve arrangement 16 is provided with a number of valves 21–25 that, in conformity with the design of the control valve arrangement 16, are realized as a slide valve device via at least one slide plate. However, in principle it is also possible for each of the valves 21–25 of the control valve arrangement 16 to be an individual valve.

The control valve arrangement 17 has the valves 26–30, which has been realized by at least one slide plate.

FIG. 1 also shows a return gas channel 31 that is formed in the rotor member 2. This return gas channel 31 conveys return gas, which is under a prescribed return gas pressure that has a high proportion of $CO_2$. FIG. 1 also shows a supply line 32 for $CO_2$ gas that is under pressure, as well a supply line 33 for saturated water vapor or steam, i.e. for steam having a temperature of about 105° to 140° C., and preferably a temperature of the order of magnitude of about 110° C.

All of the valves 21–30 have two connections, whereby one of the connections can be designated as an inlet and the other can be designated as an outlet. When one of the valves 21–30 is opened, a flow connection exists between the two connections of this valve. This flow connection is interrupted when the valves 21–30 are closed. The following discussion is based upon the assumption that the valves 21–30 are in a closed state, and only that valve 21–30 is open for which an open state is expressly indicated.

In the embodiment illustrated in FIG. 1, the bottom connection of all the valves 21–25 is connected to the connecting line 14. A throttle means 34 is provided in the appropriate bottom connection of the valve 24. The following connections apply to the other, in this embodiment upper, connections of the valves 21–25.

Valve 21 is connected via line 35 to the connecting line 13;

Valve 22 is connected via line 36 to the supply line 33:

Valves 23 and 24 are connected via line 37 to the return gas channel 31; and supply line 32.

With respect to the embodiment of FIG. 1, the lower connections of the valves 26–29 are connected to a common line 39 that in turn is connected to the connecting line 13 via the control valve 20. The lower connection of the valve 30 is also connected to the connecting line 13, via a line 40. The following connections apply to the upper connections of the valve 26–30:

Valve 26 is connected via line 41 to the atmosphere;

Valve 27 is connected via line 42 to the supply line 33;

Valve 28 is connected via line 43 to the atmosphere: and

Valves 29 and 30 are connected via lines 44 and 45 respectively to the lines 37 and to the return gas channel 31.

Each of the lines 42, 43, 44 and 45 is provided with a respective throttle means 34.

With the aforementioned construction, the following operating procedure is possible when a bottle 12 is filled with the liquid material:

1. Positioning the bottle 12 under the filling element 1

The mouth 10 of a respective bottle 12 that is to be filled and that has been preheated to a temperature of about 30° to 50° C. is brought to a sealing position against the filling element 1 in a conventional manner, i.e. by using a non-illustrated lifting mechanism to raise the bottle 12, which rests in an upright manner upon a bottle plate 46. When this has been accomplished, the long filling tube 6 extends into the interior of the bottle 12 to the vicinity of the base surface 12'.

2. Displacing the air out of the bottle 12 with steam

After the bottle 12 has been pressed and sealed against the filling element 1, a maximum stream of steam is conveyed through the connecting line 14 into the filling tube 6 via the control valve arrangement 16. At the same time, the connecting line 13 communicates with the atmosphere via the control valve arrangement 17. The air that is in the bottle 12 is thereby displaced out of the bottle 12 into the atmosphere by means of the steam that enters the interior of the bottle 12 at the bottom end of the long filling tube 6.

For this purpose, the valves 22 and 26, as well as the control valve 20, are opened. Since the control valve 20 is disposed in the flow or gas path via which initially the displaced air and later also steam are displaced out of the interior of the bottle 12 into the atmosphere, it is possible to optimally control the duration of this process with the aid of the control valve 20, and in particular independent of the speed of the filling mechanism, in such a way that at the end of this process step, a nearly pure steam atmosphere is present in the bottle 12 with a minimal consumption of steam.

3. Sterilizing the bottle 12 with saturated steam

After the air that is present in the bottle 12 has been displaced therefrom, the control valve 20 is closed. The valve 22 continues to remain open, so that the saturated steam pressure that is established and regulated in the supply line 33 is also established in the bottle 12. This condition is maintained for a predetermined period of time, i.e. a sterilization period, that corresponds to the desired sterilization or destruction rate.

4. Releasing the steam pressure out of the bottle 12

After the sterilization period has expired, the valve 22 is closed and, with the valve 26 again opened or still open the control valve 20 is also opened, so that the excess steam pressure in the bottle 12 can be vented or released to the atmosphere.

In principle, the release of the steam pressure could also be effected by slightly lowering the bottle 12 via the bottom plate 46 and the pertaining lifting mechanism relative to the filling element 1, so that the excess steam pressure can escape to the atmosphere via the mouth 10 of the bottle 12. This alternative step has the advantage that the hot steam that escapes during release of the steam pressure sterilizes the mouth 10 and also those portions of the seal 11 that form abutment surfaces for the mouth 10.

5. Displacing the steam out of the bottle 12

After release of the steam pressure, and with the bottle 12 being in a sealing position with the filling element 1, the filling tube 6 is connected to the return gas channel 31 via the control valve arrangement 16. For this purpose, the valve 24 of the control valve arrangement 16 is opened. At the same time, the valve 26 is also opened, so that after the control valve 20 has been opened, return gas flows out of the return gas channel 31 and via the connecting line 14 and the filling tube 6 into the interior of the bottle 12 in order thereby to displace the steam that is present in the bottle 12 to the atmosphere via the connecting line 13. This process step is also controlled by the control valve 20 independent of the speed of the filling mechanism, for example is time-controlled, and in particular in such a way that while an optimum displacement of all of the residual steam is effected, a minimum of return gas is used.

6. Partially pressurizing the bottle 12 with $CO_2$ gas or return gas from the return gas channel 31

After the displacement time has expired, the control valve 20 is closed, so that if the valve 24 continues to be open, a pressure equalization results between the return gas channel 31 and the interior of the bottle 12, i.e. within the interior of the bottle 12 there is established approximately the pressure of the return gas channel 31.

This partial pressurization of the bottle 12 is thus effected with the use of the $CO_2$ gas or return gas from the return gas channel 31. In other words, for this partial pressurization, a $CO_2$ gas is utilized that is being or was displaced during the filling of a different, pressurized bottle 12. This drastically reduces the consumption of $CO_2$ gas.

The partial pressurization of $CO_2$ gas from the return gas channel 31 is in particular possible due to the fact that at least the inner surfaces of each bottle 12 that is to filled, and also the filling tubes 6, are reliably sterilized with steam prior to filling a bottle, and the steam that serves as the sterilization medium is not conveyed into the return gas channel 31, but rather to the atmosphere.

This ensures that during the filling of a bottle 12, the $CO_2$ gas that is displaced from this bottle does not convey any bacteria into the return gas channel 31. In other words, the return gas that is present in this return gas channel 31 is absolutely free of bacteria, or that at the most bacteria is present only in such a slight amount that despite the partial pressurization with return gas the quality and storage ability of the material with which the respective bottle 12 or filled or not adversely affected.

7. Final-pressurizing the bottle 12 with fresh $CO_2$ gas

After the partial pressurization with return gas, the final-pressurizing is then effected utilizing fresh $CO_2$ gas from the supply line 32. For this purpose, the valve 25 is open.

To the extent that (departure from the depiction of FIG. 1) no separate supply line 32 for fresh $CO_2$ gas is provided, but rather the rotor member 2 forms a reservoir or annular vessel that is filled only partially with the liquid material, with the inner space that is disposed above the level of the liquid material being filled with pressurized $CO_2$ gas, a final-pressurizing is naturally effected utilizing the $CO_2$ gas from this gas chamber of the annular vessel.

8. Filling the bottle 12

After pressurization has been effected, the actual filling phase is initiated in a conventional manner by opening the liquid flow valve 7. For this purpose the valves 29 and 30 are opened, whereby initially the control valve 20 is closed for an initial charging phase at low filling speed. The control valve 20 is then opened for a rapid filling phase. In a subsequent slow and correction phase, the control valve 20 is again closed.

9. Venting the filled bottle 12

After conclusion of the filling phase, the bottle 12 is vented in a conventional manner. In so doing, a preliminary venting and calming to the return gas pressure is preferably initially undertaken, and in particular via the opened valve 20 and the throttle means 34 that is disposed in the line 45.

Subsequently, a final-venting to atmospheric pressure is undertaken. For this purpose, the valve 28 as well as the control valve 20 are opened. This means that this final-venting again independent of the speed of the filling mechanism, can be optimally regulated by the control mechanism that is controlled by the control valve 20.

10. Lowering the filled bottle 12

At the same time or nearly at the same time as the filled bottle 12 is withdrawn or lowered, a connection is established between the connecting lines 13 and 14 via the control valve arrangement 16: in other words, the valve 21 is opened. Thus the material present in the filling tube 6 is emptied into the bottle 12 as the latter is lowered. At the same time, by means of the control valve arrangement 17 a reduced stream of steam is achieved in the annular channel 9 of the filling element 1. For this purpose, in addition to the valve 27 the control valve 20 is also opened, with this supply of a reduced stream of steam again being controlled independent of the speed of the filling mechanism. The stream of steam that exits downward out of the channel 9 effects an additional sterilization of the mouth 10 as well as of the filling element 1, especially in the region of the seal 11. Furthermore, the stream of steam that exits downwardly out of the channel 9 also effectively prevents any bacteria from the surrounding air from passing into the filled bottle 12.

Since there continues to be a connection between the connecting lines 13 and 14 via the control valve arrangement 16, steam also exits the bottom end of the filling tube 6 when the bottom end of the filling tube leaves the filling material as the bottle 12 is lowered.

Subsequently, while maintaining the two streams of steam (the stream of steam from the channel 9 and the stream of steam from the filling tube 6). the bottle 12 is transferred into a transfer tunnel via which the filled bottle 12 is conveyed to a closure or capping mechanism, and in which the bottle is continuously subjected to steam.

After the transfer of the bottle 12 to the transfer tunnel, and with the valves 21, 27 and 20 opened, the reduced stream of steam is maintained for an additional sterilization of the filling element 1, especially in the region of the filling tube 6, the seal 11, centering means, etc.

Rather than supplying reduced steam via the filling tube 6 to the filled bottle 12, i.e. to the neck of this bottle it is also possible to subject the bottle 12 to $CO_2$ gas. In this case, when the lower end of the filling tube 6 exits the filling material level as the bottle 12 is lowered, a connection to the return gas channel 31 is established via the control valve arrangement 16. For this purpose, only the valves 23 and 27 are opened with the throttle means 34 associated with the valve 23 serving to limit the quantity of $CO_2$ gas. Furthermore, with the valve 27 opened, a reduced stream of steam exits the bottom, open side of the channel 9.

Figure 2:
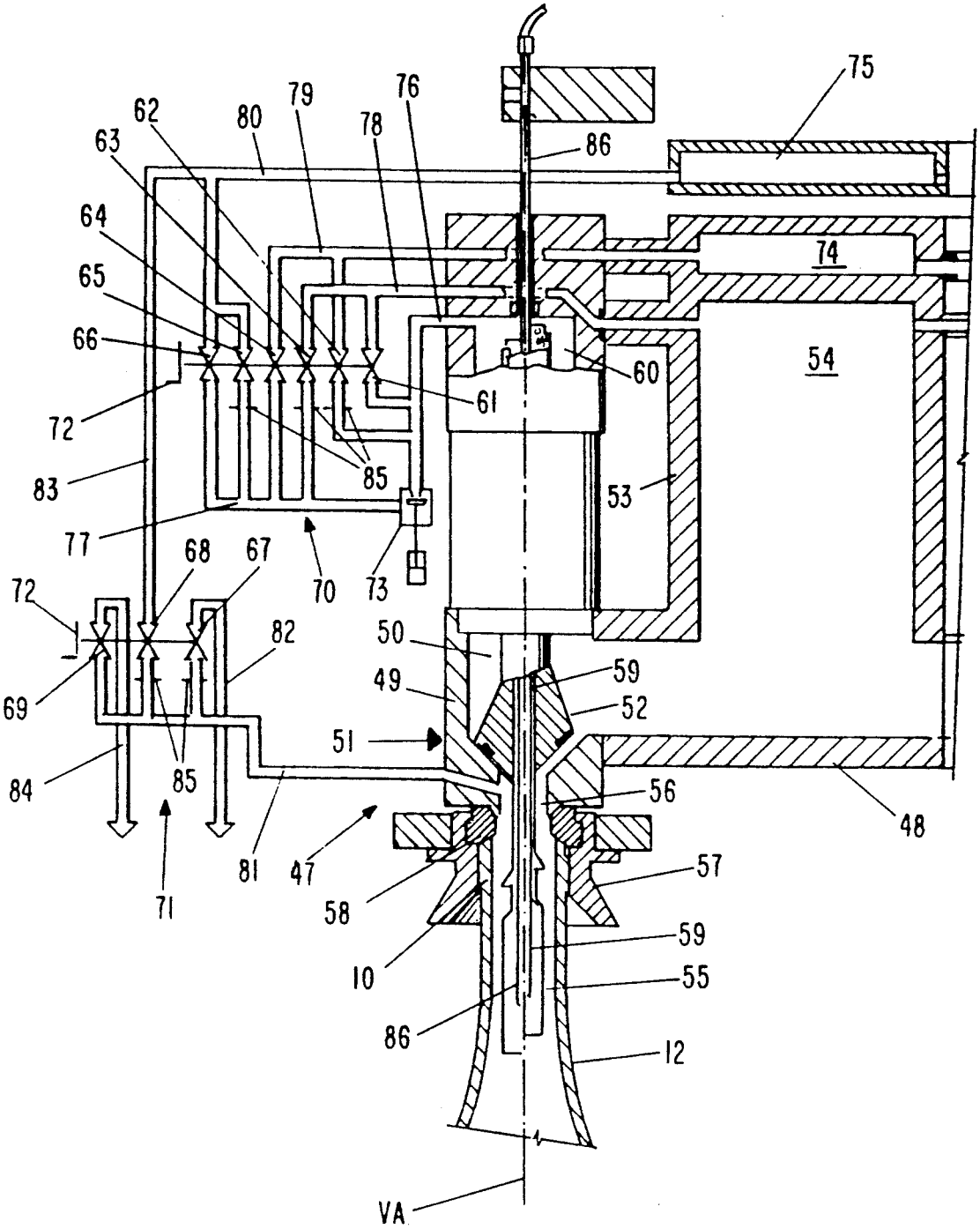
FIG. 2 is a view similar to that of FIG. 1 but of a filling element that has no filling tube.

FIG. 2 shows a further possible exemplary embodiment of the present invention, and in particular shows a filling element 47 that has no filling tube. Together with a plurality of further filling elements, &he filling element 47 is disposed on the rotor member 48 of a filling machine, with the rotor member rotating about the vertical axis of the machine. Provided in the housing 49 of the filling element 47 is a liquid channel 50 with the liquid flow valve 51, i.e. the pertaining valve body 52. The liquid channel 50 communicates with an annular reservoir 53 that is formed in the rotor member 48; the annular reservoir 53 is filled only partially with the liquid material, so that a gas space 54 for fresh, pressurized $CO_2$ gas is provided in the annular reservoir 53 above the level of the liquid material. Downstream of the liquid flow valve 51, the liquid channel 50, at the underside of the filling element 47, forms an annular outlet opening 56 that concentrically surrounds not only the filling element axis VA but also a gas tube 55 that is connected to the valve body 52. During the filling phase, with the liquid flow valve 51 open, the liquid material flows through the outlet opening 56 and into the bottle 12, which is in a sealing position relative to the sealing element 47. To tightly pres the mouth 10 of the bottle 12 against the filling element 47 a seal 58 is provided on a centering means or tulip 57.

The gas tube 55, which is open at its bottom end, forms a gas channel 59 that extends through the valve body 52 and through a non-illustrated actuating mechanism for the liquid flow valve 51 and into a chamber 60.

Associated with the filling element 47 are again two control valve arrangements 70 and 71 comprised of the valves 61–69. The control valve arrangements 70, 71 are again embodied as slide-valve mechanisms having actuating levers 72 that cooperate with stationary control elements. The control valve arrangement 70 is provided with the valves 61–66, and the control valve arrangement 71 is provided with the valves 67–69.

In addition to the control valve arrangements 70 and 71, each filling element 71 has a control valve 73 that corresponds to the control valve 20 and is actuated by the non-illustrated control mechanism; the control valve 73 is actually associated with the control valve arrangement 70.

Provided on the rotor member 48 is a return gas channel 74, which corresponds to the return gas channel 31, and a supply line 75 for saturated steam, with this supply line 75 corresponding to the supply line 33.

Each of the valves 61–69 has two connections, between which a flow connection exists when the valve is opened. When the valves 61-69 are closed, these flow connections are interrupted.

The details concerning the connections to the valves 61–69, i.e. to the connections thereof, are as follows:

In the embodiment illustrated in FIG. 2, the lower connections of the valves 61 and 62 are connected to a connecting line 76 that communicates with the chamber 60. The lower connections of the valves 63–66 are connected to a common line 77 that is connected to the connecting line 76 via the control valve 73. The following connections exist for the upper connections of the valves 61–66:

Valves 61 and 63 are connected via a line 78 to the gas space 54;

Valves 62 and 64 are connected via a line 79 to the return gas channel 74; and Valves 65 and 66 are connected via line 80 to the supply line 75.

In the embodiment of FIG. 2, the lower connections of the valves 67–69 are connected to a connecting line 81 that opens out into the liquid channel 50 downstream of the liquid flow valve 51 and upstream of the outlet opening 56. The following connections exist relative to the upper connections of the valves 67–69:

Valve 67 is connected via line 82 to the atmosphere;

Valve 68 is connected via line 83 to line 80; and

Valve 69 is connected via line 84 to the atmosphere.

Respective throttle means 85 that correspond to the throttle means 34 are disposed in the connections of the valve 62 with the connecting line 76, the valves 63 and 65 with the line 77, and the valves 67 and 68 with the connecting line 81.

The filling element 47 is furthermore provided with a probe 86 for controlling the filling height or level. The annular gas channel 59 surrounds this probe 86, which is coaxial with the axis VA.

With the embodiment illustrated in FIG. 2, an operating sequence during filling of the bottles 12 is possible that is equivalent to the aforementioned operating process described in conjunction with FIG. 1; in other words, again has the following process steps:

1. Positioning the bottle 12 under the filling element 47

The bottle 12 is brought into a sealing position with the filling element 47 using the seal 58.

2. Displacing the air out of the bottle 12 with steam

With the valves 66 and 69 open, this displacement is effected in a controlled manner via the control valve 73, and in particular independent of the rotational speed of the filling machine. For this purpose the control valve 73 is opened during a prescribed displacement duration, so that saturated steam can flow out of the supply line 75 and via the gas channel 59 into the interior of the bottle 12, and initially the displaced air and subsequently also steam are displaced via the connecting line 81 to the atmosphere.

3. Sterilizing the bottle 12 with steam

After the conclusion of the displacement phase, sterilization of the bottle 12 with saturated steam is effected. For this purpose, the valve 69 is closed and, with the valve 66 opened, the control valve 73 is also open for a prescribed sterilization duration.

4. Releasing the steam pressure out of the bottle 12

After expiration of the sterilization period, the control valve 73 is closed. To release the steam pressure, the valve 69 is now opened.

Alternatively, to accomplish this the bottle 12 can be lowered slightly and for a short period of time from the filling element 47; this has the advantage of being able to sterilize the mouth 10 as well as the seal 58.

5. Displacing the steam out of the bottle 12

With the valves 64 and 69 open, the control valve 73 is opened for a prescribed period of time, again independent of the speed of the filling mechanism. As a result, the gas channel 59 is connected to the return gas channel 74, whereby at the same time the interior of the bottle 12 is open to the atmosphere via the connecting line 81 and the open valve 69, so that the steam that is present in the bottle 12 is displaced to the atmosphere by means of the return gas or $CO_2$ gas that is entering from the return gas channel 74. This process step is terminated by closing the valve 73.

The opening time of the valve 73 is again selected such that a complete as possible displacement of the steam out of the bottle 12 is effected with a minimum consumption of $CO_2$ gas.

6. Partially pressurizing the bottle 12 with $CO_2$ gas from the return gas channel 74

For this purpose, the valve 69 is closed. With the valve 64 open, the control valve 73 is opened, so that a pressure that corresponds to the pressure in the return gas channel 74 builds up in the interior of the bottle 12. For this partial pressurization, $CO_2$ gas from the return gas channel 74 is again used. This is also possible with the embodiment of FIG. 2 in that each bottle 12 that is to be filled is sterilized with saturated steam prior to the filling process, and furthermore no steam is diverted into the return gas channel 74 in any of the process steps.

After the partial pressurization of the bottle 12 with the $CO_2$ gas from the return gas channel 74, the aforementioned process steps 7 to 10 that were described in conjunction with the embodiment of FIG. 1 are effected in an analogous manner. Here also the control valve 73 is again utilized to control the filling speed during the filling phase as well as to control the reduced stream of steam during withdrawal of the bottle 12 from the filling element 47.

During final-pressurization with the fresh $CO_2$ gas from the gas space 54, the valve 61 is opened. During the filling process, in addition to the filling or liquid flow valve 51, the valves 62 and 64 are also opened, whereby during the rapid filling phase, which takes place between the charging phase and the slow-down phase, the control valve 73 is opened. The preliminary venting of the filled bottle 12 is again effected to the pressure of the return gas channel 74, and in particular by opening the valve 62. The final-venting to atmospheric pressure is effected by opening the valve 67. To treat the filled bottle 12 with a reduced stream of steam during withdrawal of the bottle, with the valve 65 and 68 opened the control valve 73 is also opened for a prescribed period of time. With the control valve 73 the stream of steam that exits the lower end of the return gas tube 55 is hereby controlled. Instead of the stream of steam that exits the return gas tube 55, it is possible at this point also to treat the bottle 12 (neck gasification) with $CO_2$ gas from the return gas channel 74. For this purpose, for example the valve 64 is opened.

Thus, the aforementioned apparatus as well as the processes possible therewith have the following advantages, among others:

By means of the control valves 20, 73, an optimum control of the respective quantity of steam or return gas independent of the speed of the filling machine is possible. In this connection, one and the same control valve 20, 73 can be used in successive process steps for different media (steam and $CO_2$ gas) and for different functions.

However, the critical advantage is that due to the preliminary treatment of each bottle 12 with steam, a nearly pure $CO_2$ atmosphere is obtained in the return gas channel 31, 74 and in addition the $CO_2$ gas that is withdrawn and present in the return gas channel has a microbiologically satisfactory condition, so that this $CO_2$ gas can be reused for the partial pressurization of the bottle 12 without having to first treat the $CO_2$ gas from the return gas channel 31.

Figure 3:
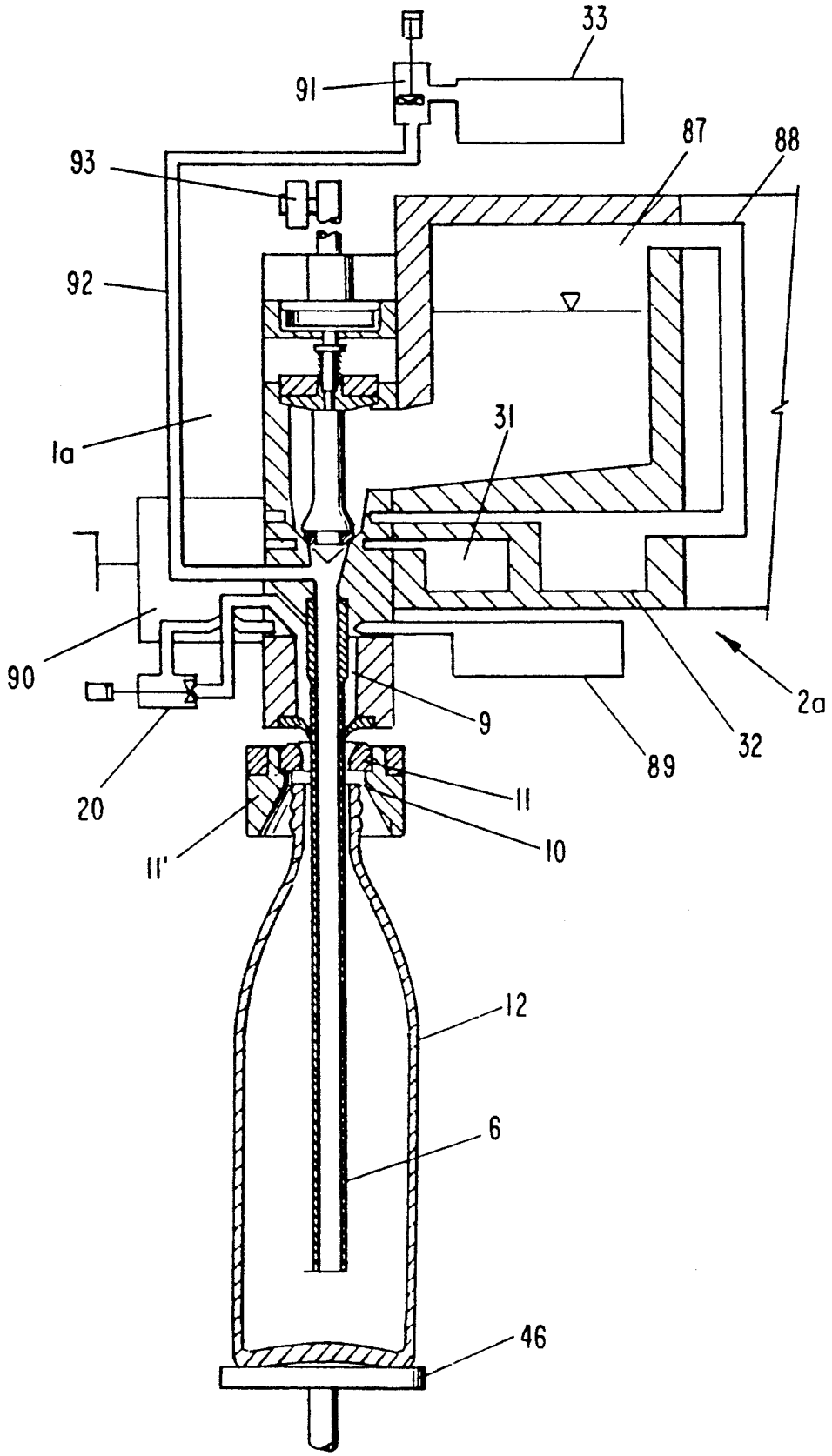
FIG. 3 is a view similar to that of FIG. 1 of a further exemplary embodiment of a filling element having a long filling tube, together with a bottle that is to be filled.

The embodiment of FIG. 3 illustrates a filling element 1*a* on the rotating rotor member 2*a*, which has an annular channel or reservoir 5*a* that essentially differs from the annular reservoir 5 of the embodiment of FIG. 1 in that the reservoir 5*a* is filled with the liquid material only to a prescribed level, so that a gas space 87 is obtained above the level of the filling material. This gas space 87 is connected via a connecting line 88 to the supply line 32 formed on the rotor member 2*a* for pressurized, fresh $CO_2$ gas.

Also provided on the rotor member 2*a* are the supply line 33 for steam, the return gas channel 31, as well as a collecting channel 89.

From a structural standpoint, the filling element 1*a* essentially corresponds to the filling element 1 of the embodiment of FIG. 1. However, instead of the two control valve arrangements 16 and 17, each filling element la has associated therewith merely a single control valve arrangement 90 that is again embodied as a slide-valve mechanism. As the filling machine rotates, the actuating lever of the control valve arrangement 90 cooperates with the stationary control element. Each control valve arrangement 90 is provided with the control valve 20 as well as a control valve 91 that is disposed in a connecting line 92 via which the control valve arrangement 90 is connected to the supply line 33 for steam; the control valve 91 is also pneumatically or electrically actuatable. This control valve 91 effects the control (blocking and release) of the steam in the individual treatment phases, so that the control valve arrangement 90, i.e. the slide plate thereof, can be used exclusively for the remaining control functions, and therefore only a single control valve arrangement 90 is required. Furthermore, the control of the valve 91 is preferably such that although this valve is opened at the beginning of the respective treatment phase and is again closed at the conclusion of this treatment phase, after expiration of a prescribed period of time, however, a forced closing of the valve 91 is effected in any case so that, for example when the machine is shut down, a discharge of steam from those filling elements that happen to be in a steam treating position, is to a large extent avoided. In addition, the control of the valve 91 can also be effected in such a way that an opening of this valve is prevented if either no bottle 12 or a element 1*a*.

The following operating sequence is possible during filling of the bottles 12 with the filling element 1*a*, whereby this operating sequence essentially corresponds to the operating sequence previously described in conjunction with the filling element 1:

1. Positioning the bottle under the filling element 1*a* and pre-rinsing the bottle 12 with steam For this purpose, the bottle 12 that is to be filled is positioned in the conventional manner, i.e. by being raised via the bottle plate 46 in such a way that although the mouth 10 of the bottle rests against the seal 11 or centering means or tulip 11', the latter is spaced from the underside of the filling element 1*a* or from a seal located there.

With the control valve 91 opened and the valve 20 closed, there is effected via the control valve arrangement 90 a reduced stream of steam to the filling tube 6 and the channel 9, and in particular via the throttle means that is provided in the control valve arrangement 90. With this reduced stream of steam, the pre-rinsing in the interior of the bottle 12 as well as at the same time a sterilization of the underside of the filling element 1*a* and the upper side of the centering means 11' are effected.

2. Displacing the residual air out of the bottle 12 with steam

In this procedural step, with the control valve 91 opened steam is introduced via the control valve arrangement 90 and the filling tube 6 into the bottle 12, which has been brought into a sealing position with the filling element 1*a*. Via the open control valve 20, the displaced air as well as steam are withdrawn into the collecting channel 89.

3. Sterilizing the bottle 12 with saturated steam

For this purpose, in contrast to the preceding process step, merely the control valve 20 is closed, so that the interior of the bottle 12 continues to be supplied with hot steam (about 110° C.) or with a steam pressure (about 0.8 bar) via the filling tube 6.

4. Sterilizing the centering means 11' and the mouth 10

For this process step, the centering means or tulip 11' (via a roller 93 that is disposed on a guide rod and cooperates with a control cam) and the bottle plate 46 (via a lifting mechanism) are lowered in a controlled manner in such a way that sufficiently wide annular gaps are respectively provided between the underside of the filling element 1*a* and the centering means 11' as well as between the mouth 10 and the seal 11. With the control valve 91 continuing to be opened and the control valve 20 being closed, steam escapes from the annular gap and effects a sterilization of the underside of the filling element 1*a*, the centering means 11', and the mouth 10.

With the control valve 91 closed, there are subsequently effected the displacement of the steam out of the bottle 12, the partial and complete pressurization of the bottle 12 with $CO_2$ gas initially out of the return gas channel 31 and subsequently out of the supply line 32, the filling of the bottle 12, as well as the venting of the filled bottle, as previously described in conjunction with the embodiment of FIG. 1 in the process step 5–9 thereof.

The process steps that then follow are:

5. Emptying the filling tube 6

With this process step, the control valves 20 and 91 are opened so that the filling tube 6 is supplied with steam and steam simultaneously exits the channel 9 to sterilize the underside of the filling element 1*a* and the centering means 11'.

6. Sterilizing the outer components and gasifying the bottle neck

The operating state of process step 5. is maintained while the bottle 12 is further lowered. The respectively filled bottle 12 is subsequently transferred into the transfer channel, which has its own steam discharge jets.

The present invention has been described in conjunction with specific embodiments. It is to be understood that alterations and modifications are possible without thereby deviating from the inventive concept. The filling elements 1 and 47 have probes to determine the filling height. It is to be understood that the present invention is not limited to the use of such filling elements.

The present invention is, of course, in no way restricted to the specific disclosure of the specification and drawings, but also encompasses any modifications within the scope of the appended claims.

What I claim is:

1. A method of filling a container with liquid material using a filling element that has a liquid flow valve, said method including the steps of:

bringing said container into a sealing position with said filling element;

in a preliminary pressurizing phase, rinsing and at least partially pre-pressurizing said container with an inert gas;

in a subsequent filling phase, with said liquid flow valve in an open state, filling said container with said liquid material, whereby return gas that is displaced from said container by entering liquid material is at least for a time withdrawn via a return gas path of said filling element into a return gas channel, and whereby in said preliminary pressurizing phase said rinsing as well as said at least partial pre-pressurizing of said container is effected using, as said inert gas, said return gas from said return gas channel;

in a preliminary treatment phase that precedes said preliminary pressurizing phase, treating the interior of said container with a sterilization medium to displace air out of said interior of said container; and withdrawing said displaced air, as well as sterilization medium that is displaced out of said interior of said container by said rinsing with an inert gas during said preliminary pressurizing phase, to at least one of the atmosphere and a channel that is independent of said return gas channel.

2. A method according to claim 1, wherein said return gas from said return gas channel is used to partially pre-pressurize said container; and which includes the further step of final-pressurizing said container with fresh inert gas.

3. A method according to claim 1, which, for introduction of said sterilization medium, includes the step of connecting said interior of said container, via a first gas path formed in said filling element, with a source for said sterilization medium.

4. A method according to claim 3, which, for said displacement of air out of said interior of said container, includes the step of connecting said interior of said container to the atmosphere via a second gas path formed in said filling element.

5. A method according to claim 4, which, during said preliminary pressurizing phase, for said rinsing and pre-pressurizing, includes the step of connecting said interior of said container to said return gas channel via a third gas path formed in said filling element.

6. A method according to claim 5, which, during said preliminary pressurizing phase and after partial prepressurization, includes the step of connecting said interior of said container, via a fourth gas path formed in said filling element, with a source for fresh inert gas.

7. A method according to claim 5, which, during rinsing, includes the step of connecting said interior of said container to the atmosphere via a gas path formed in said filling element, preferably via said second gas path means.

8. A method according to claim 4, which, when utilizing a rotating-type filling machine having a plurality of said filling elements, includes the steps of: providing for each of said plurality of filling elements a first control valve; and, via said first control valve, and independent of a speed of said filling machine, controlling at least one of: a duration of the treatment of said container in said preliminary treatment phase; said at least partial prepressurization of said container with return gas; and said displacement of said sterilization medium with return gas.

9. A method according to claim 4, which, when utilizing a rotating-type filling machine having a plurality of said filling elements, includes the steps of: providing for each of said plurality of filling elements a second control valve; and, via said second control valve, preferably independent of a speed of said filling machine, controlling a duration of treatment with said sterilization medium, especially in at least one of said preliminary treatment phase and a post treatment phase that is effected after said filling phase.

10. A method according to claim 9, which includes the step of providing said second control valve in a line that connects a control valve arrangement with said source for said sterilization medium.

11. A method according to claim 8, which, in addition to at least one of said first control valve and a second control valve, includes the step of providing at least one control valve arrangement for said gas path, said at least one control valve arrangement cooperating with stationary control elements.

12. A method according to claim 11, which includes the step of providing two control valve arrangements, one of which, together with said first control valve, is disposed in at least one of said first and second gas path.

13. A method according to claim 8, which includes the step of using said first control valve during said filling phase to control a filling speed.

14. A method according to claim 3, which includes the step of providing a first supply means as said source for said sterilization medium.

15. A method according to claim 6, which includes the step of providing a storage reservoir for said liquid material, with said source for fresh inert gas being a gas space formed above a level of said liquid material in said reservoir.

16. A method according to claim 6, which includes the steps of providing a second supply means as said source for fresh inert gas, and providing a separate reservoir for said liquid material.

17. A method according to claim 1, which, where said filling element has a filling tube, includes the step of effecting treatment of said interior of said container with said sterilization medium via said filling tube.

18. A method according to claim 1, which, where said filling element has no filling tube, includes the step of effecting treatment of said interior of said container with said sterilization medium via a portion of said return gas path that serves for the withdrawal of displaced return gas during said filling phase, said portion of said return gas path being in communication with said interior of said container.

19. A method according to claim 18, which includes the step of providing, as said portion of said return gas path, a gas channel of a gas tube of said filling element.

20. A method according to claim 1, which includes at least one of the steps of: for said preliminary treatment phase, preheating said container, for example to a temperature of from 30° to 50° C.; and, at the conclusion of said preliminary treatment phase, releasing the pressure of said sterilization medium to the atmosphere via a gap provided between said filling element and a mouth of said container.

21. A method according to claim 1, which, prior to rinsing of said container, includes the steps of: introducing said sterilization medium into said interior of said container to sterilize a mouth of said container as well as a centering means of said filling element provided for centering said container; and discharging said sterilization medium via annular openings provided between said mouth of said container and said centering means and said filling element.

22. A method according to claim 1, which includes the step of using as said sterilization medium saturated steam having a temperature of from 105° to 140° C., preferably 110° C.

23. In an apparatus for filling a container with liquid material, said apparatus having at least one filling element, which has a liquid flow valve, said apparatus also having at least one control valve mechanism that is operatively associated with said at least one filling element and has a plurality of valves, with said at least one control valve mechanism serving for the control of gas paths formed in said at least one filling element, at least during a preliminary pressurizing phase in which said container, when in a sealing position with said at least one filling element, is rinsed and at least partially pre-pressurized with an inert gas, and also during a subsequent filling phase in which said container, which is in a sealing position with said at least one filling element, with said liquid flow valve in an open state, is filled with said liquid material, whereby at least for a time return gas that is displaced from said container by entering liquid material is withdrawn via a return gas path providing in said at least one filling element into a return gas channel of said apparatus, and whereby in said preliminary pressurizing phase said rinsing as well as said at least partial pre-pressurizing of said container is effected using, as said inert gas, said return gas from said return gas channel, the improvement comprising:

a source for a sterilization medium which, via said at least one control valve mechanism, is adapted to act upon an interior of said container in a preliminary treatment phase that precedes said preliminary pressurizing phase, thereby displacing air out of said interior of said container; and outlet means for withdrawing said displaced air, as well as sterilization medium that is displaced out of said interior of said container during said rinsing in said preliminary pressurizing phase, to at least one of the atmosphere and a channel of said apparatus that is independent of said return gas channel thereof.

24. An apparatus according to claim 23, wherein a source for fresh inert gas is provided, and wherein said at least one control valve mechanism is embodied in such a way as to effect, in said preliminary pressurizing phase, after partial prepressurization of said container, a finalpressurization with said fresh inert gas.

25. An apparatus according to claim 23, wherein a first gas path is provided in said at least one filling element, said interior of said container being connectable to said source for said sterilization medium via said first gas path.

26. An apparatus according to claim 25, wherein a second gas path is provided in said at least one filling element, said interior of said container being connectable to the atmosphere via said second gas path during at least one of: said preliminary treatment phase, for said displacement of air out of said container; and said preliminary pressurizing phase during said rinsing step thereof.

27. An apparatus according to claim 26, wherein a third gas path is provided in said at least one filling element said interior of said container being connectable to said return gas channel for at least one of said rinsing and pre-pressurizing of said preliminary pressurizing phase.

28. An apparatus according to claim 27, wherein a fourth gas path is provided in said at least filling element, said interior of said container being connectable, in said preliminary pressurizing phase after partial prepressurization, to a source for fresh inert gas.

29. An apparatus according to claim 28, wherein, when utilizing a rotating-type filling machine having a plurality of filling elements, a second control valve of said at least one control valve mechanism is provided for at most a group of said plurality of filling elements, said second control valve, preferably independent of a speed of said filling machine, controlling said treatment with said sterilization medium.

30. An apparatus according to claim 29, wherein said second control valve is disposed in one of: said first gas path, and a line that connects a control valve arrangement with said source for said sterilization medium.

31. An apparatus according to claim 28, wherein, when utilizing a rotating-type filling machine having a plurality of filling elements, a first control valve of said at least one control valve mechanism is provided for each of said plurality of filling elements, said first control valve, independent of a speed of said filling machine, controlling at least one of: said treatment of a respective one of said containers in said preliminary treatment phase; said at least partial pressurization of said container with said return gas; and said displacement of said sterilization medium and said rinsing of said container with said return gas.

32. An apparatus according to claim 31, wherein, in addition to at least one of said first control valve and a second control valve, said at least one control valve mechanism includes, for each of said plurality of filling elements, at least one control valve arrangement for said gas path, said control valve arrangement cooperating with stationary control elements.

33. An apparatus according to claim 32, wherein two control valve arrangements are provided for each of said plurality of filling elements, and one of said control valve arrangements, together with said first control valve is disposed in at least one of said first, second, third and fourth gas paths.

34. An apparatus according to claim 33, wherein said first control valve is used during said filling phase to control a filling speed and, preferably together with said one control valve arrangement, is disposed in said return gas path.

35. An apparatus according to claim 25, wherein said source for said sterilization medium is a first supply means.

36. An apparatus according to claim 28, wherein a storage reservoir for said liquid material is provided, and wherein said source for fresh inert gas is a gas space formed above said liquid material in said reservoir.

37. An apparatus according to claim 28, wherein said source for fresh inert gas is a second supply means, and a separate reservoir is provided for said liquid material.

38. An apparatus according to claim 32, wherein said at least one first and second control valve is at least functionally disposed in series with said at least one control valve arrangement in such a way that a pertaining one of said gas paths is readied by said control valve arrangement and is controlled by said control valve.

39. An apparatus according to claim 31, wherein each of said plurality of filling elements is provided with a liquid channel, a filling tube, and a connecting line that communicates with a portion of said liquid channel that is disposed downstream of said liquid flow valve and communicates with said filling tube, whereby at least one of said sterilization medium and said return gas from said return gas channel is supplied via said connecting line.

40. An apparatus according to claim 31, wherein each of said plurality of filling elements has no filling tube and has a gas channel that forms a portion of said return gas path, whereby at least one of said sterilization medium and said return gas is adapted to be conveyed via said gas channel.

41. An apparatus according to claim 39, wherein said first control valve is disposed in said return gas channel and in said second gas path.

42. An apparatus according to claim 40, wherein said first control valve is disposed in said return gas channel and in at least one of said first, third and fourth gas paths.

* * * * *